United States Patent [19]

Kleim et al.

[11] Patent Number: 4,867,072

[45] Date of Patent: Sep. 19, 1989

[54] MULTI-UNIT RAIL VEHICLE FOR COMMUTER TRAFFIC

[75] Inventors: Karl-Heinz Kleim, Nuremberg; Lutz Uebel, Heroldsberg, both of Fed. Rep. of Germany

[73] Assignee: Man Gutehoffnungshütte GMBH, Oberhausen, Fed. Rep. of Germany

[21] Appl. No.: 303,962

[22] Filed: Jan. 27, 1989

Related U.S. Application Data

[63] Continuation-in-part of Ser. No. 104,708, Oct. 2, 1987, abandoned.

[30] Foreign Application Priority Data

Oct. 4, 1986 [DE] Fed. Rep. of Germany ..... 3633843
Feb. 11, 1987 [DE] Fed. Rep. of Germany ..... 3704127

[51] Int. Cl.[4] ..... B61C 3/00; B61C 9/52

[52] U.S. Cl. ..... 105/133; 105/34.1; 105/49

[58] Field of Search ..... 105/134, 135, 136, 137, 105/138, 139, 140, 34.1, 49, 34.2, 118, 131, 3, 26.05, 133

[56] References Cited

U.S. PATENT DOCUMENTS 1,883,357 10/1932 Fageol ..... 105/119
2,056,219 10/1936 Stout et al. ..... 105/119
3,014,433 12/1961 Durand ..... 105/131

FOREIGN PATENT DOCUMENTS 0210519 2/1987 European Pat. Off. ..... 105/34.1
3504471 8/1986 Fed. Rep. of Germany .

*Primary Examiner*—Andres Kashnikow
*Assistant Examiner*—Mark T. Le
*Attorney, Agent, or Firm*—Becker & Becker

[57] ABSTRACT

A multi-unit rail vehicle for commuter traffic. To keep the entry and exit of the vehicle only slightly higher than the level of the street, and to make it possible to travel through the entire vehicle without steps, a continuous, level central walkway is provided that is at the same height as the entryway. To accommodate the driving bogie, the wheel sets are driven via drive shafts and reduction gear mechanisms. The drive motors can be disposed to the side below the car body and beyond the pivot range of the bogie. If room permits, vertical motors can also be provided in one corner of the car body, with such a vertical motor also driving the wheel sets via drive shafts and reduction gear mechanisms. Advantageously, two drive motors can be provided that are disposed diagonally across from one another relative to the point of rotation of the bogie, with the drive shafts of the motors being parallel to the wheel sets, and torque being transferred via further drive shafts. To accommodate the central walkway, the cross members of the bogie are angled-off. By disposing the entryway and the continuous central walkway on the same level, loading and unloading of passengers is accelerated, stopping times are reduced, and expensive platforms at the level of the vehicle floors are eliminated.

5 Claims, 8 Drawing Sheets

MULTI-UNIT RAIL VEHICLE FOR COMMUTER TRAFFIC

This is a continuation-in-part application of copending parent application Ser. No. 104,708 now abandoned Kleim et al filed Oct. 2, 1987 and belonging to the assignee of the present invention.

BACKGROUND OF THE INVENTION

The present invention relates to a multi-unit rail vehicle for local or commuter traffic, with each of the pivotably interconnected car bodies of the vehicle being supported, via rubber springs as secondary shock absorbers, on a driving bogie that is disposed below the center of the car body.

German Offenlegungsschrift No. 35 04 471 Bucholz et al dated Aug. 14, 1986 corresponding to South African Patent No. 86/0909 (in English) and belonging to the assignee of the present invention discloses supporting pivotably connected car bodies of multiunit rail vehicles on a driving bogie that is disposed below the center of the car body. Used as secondary shock absorbers are rubber springs that, via a sufficient return force, are prepared to return the bogie to a straight-ahead position after passing through a curve. Each of the bogies is embodied as a driving bogie. A drawback of this known construction is that the height of the floor of the vehicle is relatively high due to the driving bogie, so that a complicated entry or exit is required in order to enable comfortable boarding and disembarking where the railway platform is at the level of the street.

Proceeding from vehicles of the aforementioned general type, it is an object of the present invention to embody driving bogies and car bodies in such a way that entry and exit can be effected without complicated and inconvenient step constructions, and that the passenger can walk along the entire train at the same level, i.e. without having to negotiate steps or the like.

BRIEF DESCRIPTION OF THE DRAWINGS

This object, and other objects and advantages of the present invention, will appear more clearly from the following specification in conjunction with the accompanying schematic drawings, in which.

SUMMARY OF THE INVENTION

Figure 1:
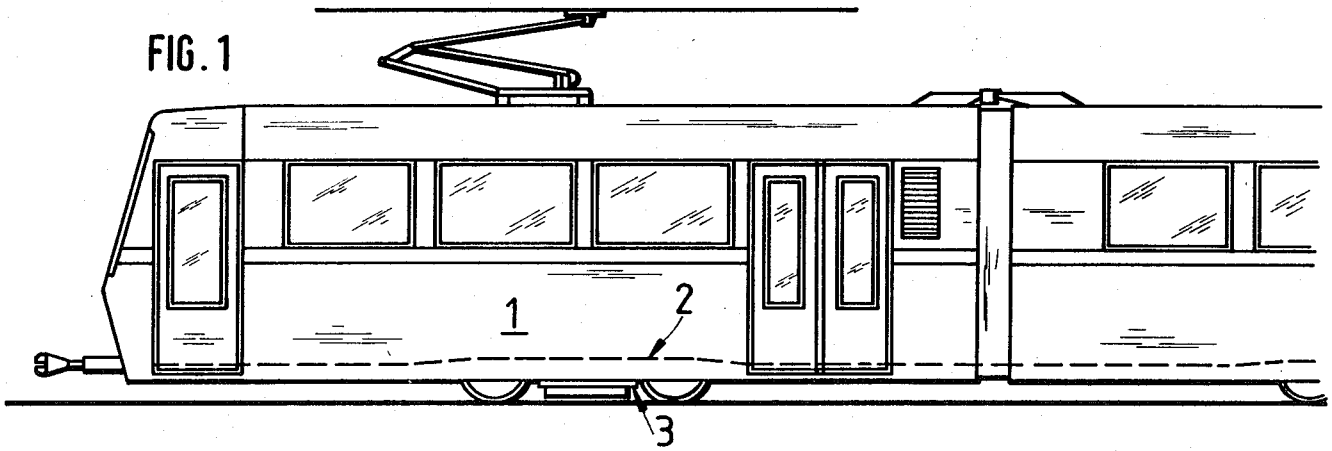
FIG. 1 is a side view of a car body having a continuous central walkway.
Figure 2:
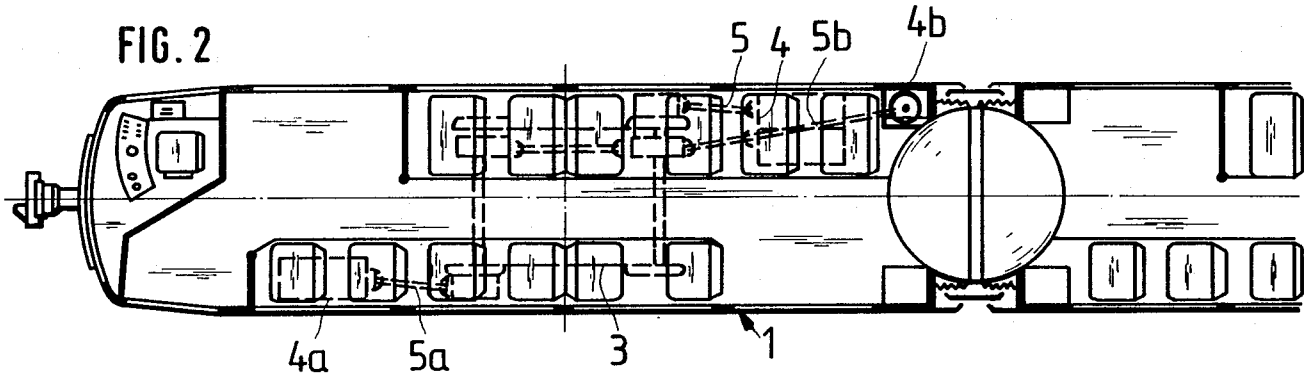
FIG. 2 is a plan view of a car body showing various arrangements for a drive motor.

The multi-unit rail vehicle of the present invention comprises at least one drive motor for each driving bogie, with each drive motor being disposed below the car body, off to the side, and beyond a pivot range of the bogie, and with transfer of torque being effected from a given one of these motors to at least one wheel set of the associated driving bogie via drive shaft means and reduction gear mechanism means; the inventive rail vehicle also comprises angled-off cross members that interconnect the longitudinal members of a given driving bogie in such a way as to accommodate, with clearance, a level central walkway that extends through the entire vehicle.

By arranging the drive motors to the side of the driving bogies, below the car bodies, and by providing angled-off cross members that interconnect the longitudinal members of the bogie, it is possible to provide a central walkway that is disposed at a very low level and extends throughout the entire train. As a result, where the railway platform is at the level of the street, passengers do not have to negotiate inconvenient step arrangements, which also require a lot of maintenance, in order to reach the level of the floor of the vehicle. Furthermore, high platforms are also avoided that are not only expensive, but that cannot always be realized due to other traffic that uses the platform.

Pursuant to one preferred embodiment of the present invention, a given driving bogie is provided with two drive motors that are disposed diagonally across from one another below the car body and off to the side, with each drive motor having associated with it a reduction gear mechanism that is mounted on a free end of an associated wheel set axle.

Pursuant to another inventive embodiment, a given driving bogie is provided with a single drive motor that is disposed below the car body and off to the side, with the drive motor having a first drive shaft that transfers torque to a first wheel set of the driving set via a first reduction gear mechanism, which is disposed within the first wheel set; the driving bogie also includes a second drive shaft and a second gear mechanism for transfer of torque from the first wheel set to a second wheel set.

Pursuant to yet another inventive embodiment, the driving bogie can be provided with a drive motor that is disposed in the car body and transfers torque to a first wheel set of the bogie via a first, vertically disposed drive shaft, a bevel gearing, a second drive shaft, and a first reduction gear mechanism, which is disposed within the first wheel set; the driving bogie also includes a second drive shaft and a second gear mechanism for transfer of torque from the first wheel set to a second wheel set of the bogie.

It is also possible to provide a driving bogie with two drive motors where the drive shafts are essentially disposed parallel to the wheel sets of the bogie, and, relative to the point of rotation of the bogie, the drive motors are disposed either diagonally across from another on opposite sides of the longitudinal axis of the bogie, or are disposed symmetrically relative to the longitudinal axis of the bogie; each of the drive motors transfers torque to a given wheel set via a further drive shaft and a reduction gear mechanism that is disposed outside of the wheel set.

Further specific features of the present invention will be described in detail subsequently.

DESCRIPTION OF PREFERRED EMBODIMENTS

Referring now to the drawings in detail, FIG. 1 shows a vehicle or car body of a multi-unit rail vehicle for local or commuter traffic. The vehicle is characterized by an extremely low-lying central walkway 2, with each car body 1 being supported by a driving bogie 3 that is disposed centrally below the car body 1.

In order to accommodate traction or drive motors in the driving bogie 3, it is proposed pursuant to the embodiment of FIG. 3, as one alternative, to dispose below the car body 1, beyond the pivot range of the bogie 3, a drive motor 4 that is disposed to the side and that drives a wheel and axle set (FIGS. 6 and 7) via gear means 5.

As an alternative, it is also possible to provide two drive motors 4 and 4*a* that are disposed diagonally opposite one another and to the sides below the car body 1, with these drive motors driving not-illustrated wheel sets via gear means 5, 5*a*.

Instead of the drive motors 4 and 4*a*, it is possible to provide a motor 4*b* that is vertically disposed in the car body and that drives the wheel sets of the bogie 3 via gear means 5*b*.

Figure 3:
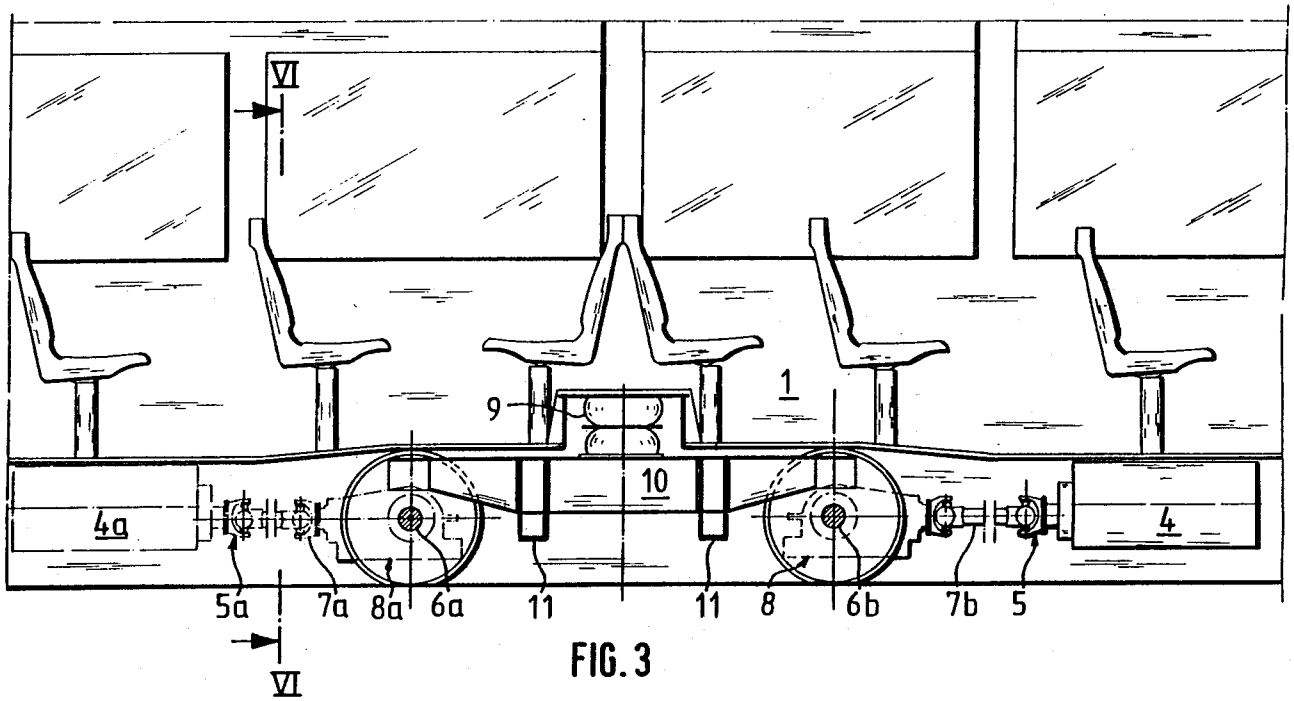
FIG. 3 is a side view of a car body, in the region of the driving bogie, and shows two drive motors.
Figure 6:
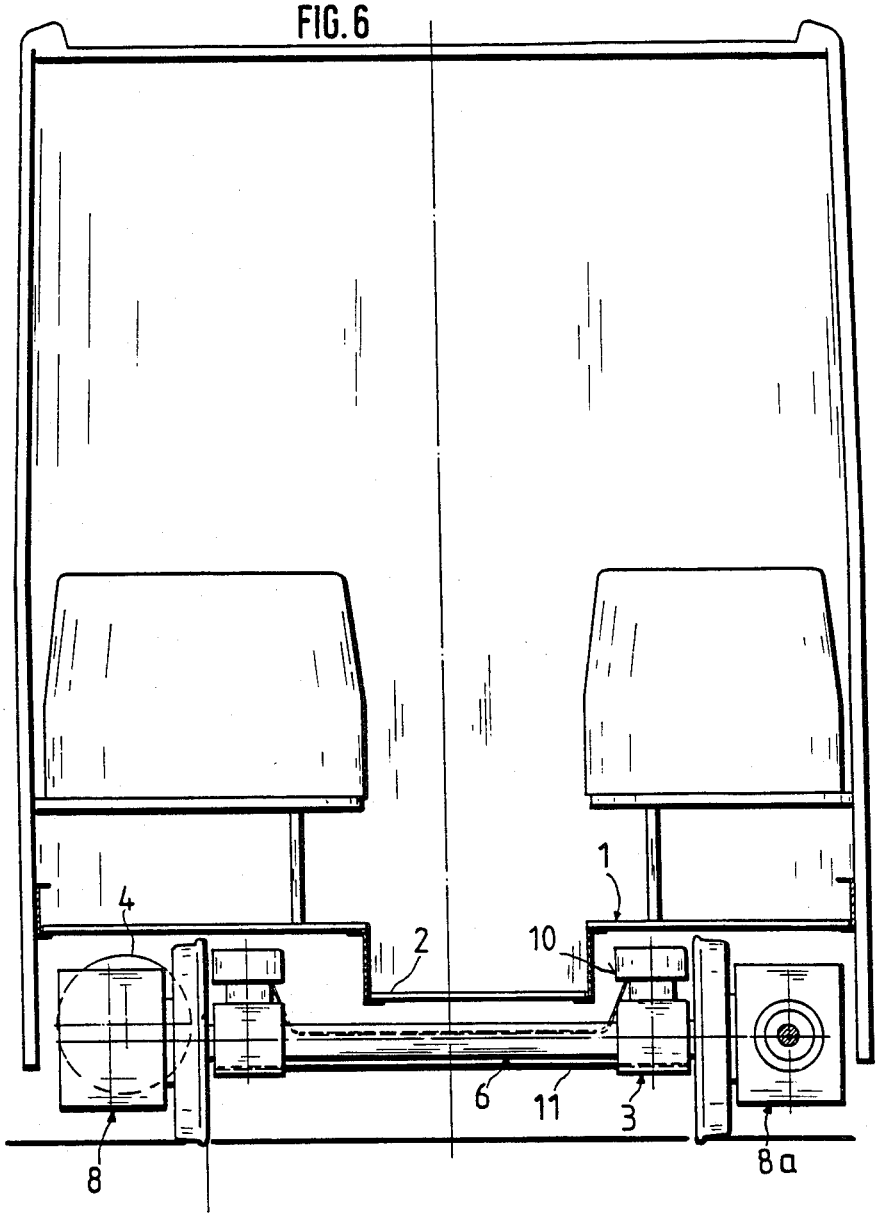
FIG. 6 is a cross-sectional view taken along the line VI—VI in FIG. 3, and shows two drive motors and reduction gear mechanisms off to the side.
Figure 7:
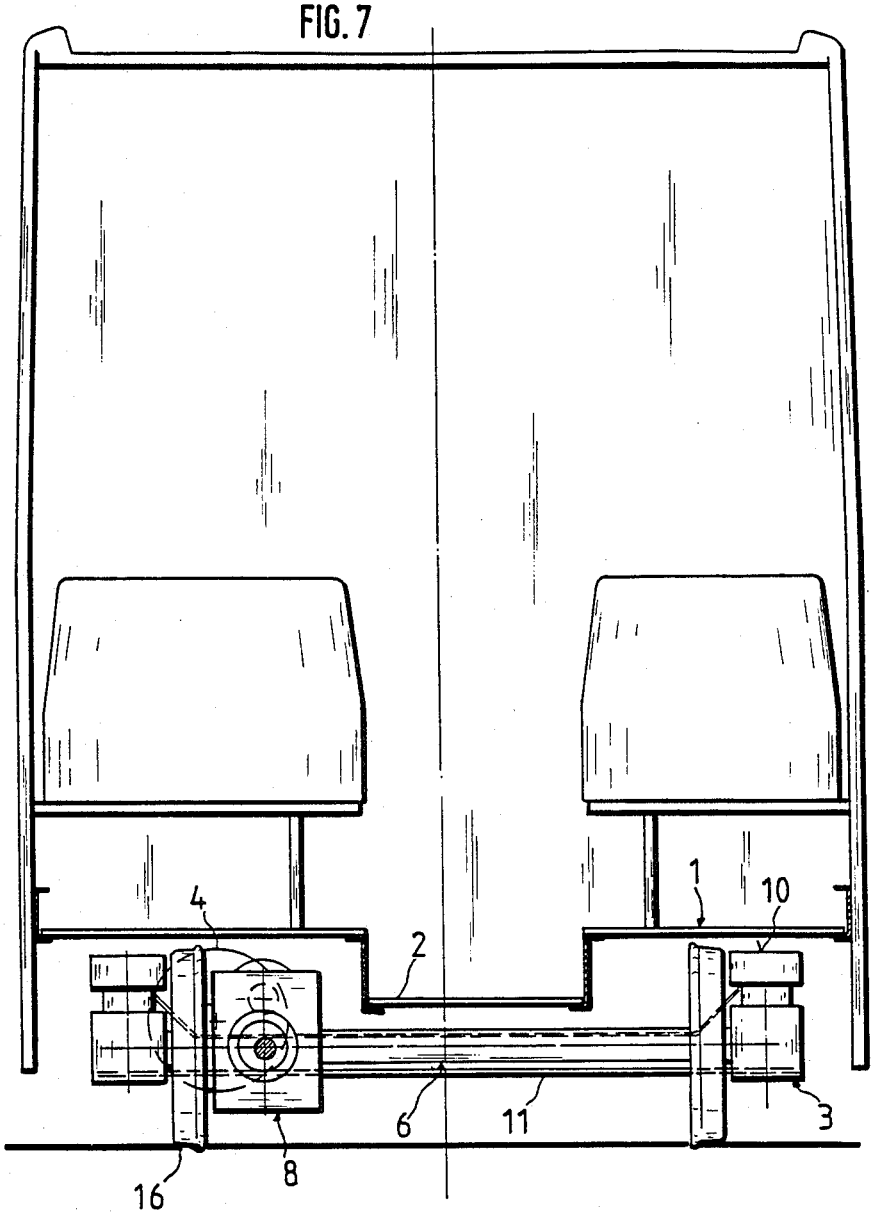
FIG. 7 is a cross-sectional view taken along the line VII—VII in FIG. 4, and shows a single drive motor and a reduction gear mechanism that is disposed between the wheels.

FIG. 3 is a side view of the driving bogie region, and shows two drive motors 4 and 4*a* for driving the wheel sets 6*a* and 6*b*. The drive motors 4 and 4*a*, which are disposed below the car body 1, are connected to the wheel sets 6*a* and 6*b* via gear means 5 and 5*a*. The gear means can include drive shafts 7*a* and 7*b* that transmit the engine torque via a reduction gear mechanism 8, 8*a*. A lower overall height of the central walkway 2 (FIGS. 6 and 7) is achieved with the inventive arrangement of the drive motors 4, 4*a*, so that the passenger can walk through the entire train on a single level. The car body 1 is furthermore supported on longitudinal members 10 via rubber springs or shock absorbers 9. The longitudinal members 10 are interconnected by underslung or bent cross members 11 (FIGS. 6 and 7). The bending allows the lowlying central walkway to be adopted, which makes it possible to do away with inconvenient boarding or disembarking where the railway platforms are low but the floors of the cars are high. Pursuant to the present invention, entry and exit is also kept low and all at the same level, just like the central walkway 2.

Figure 4:
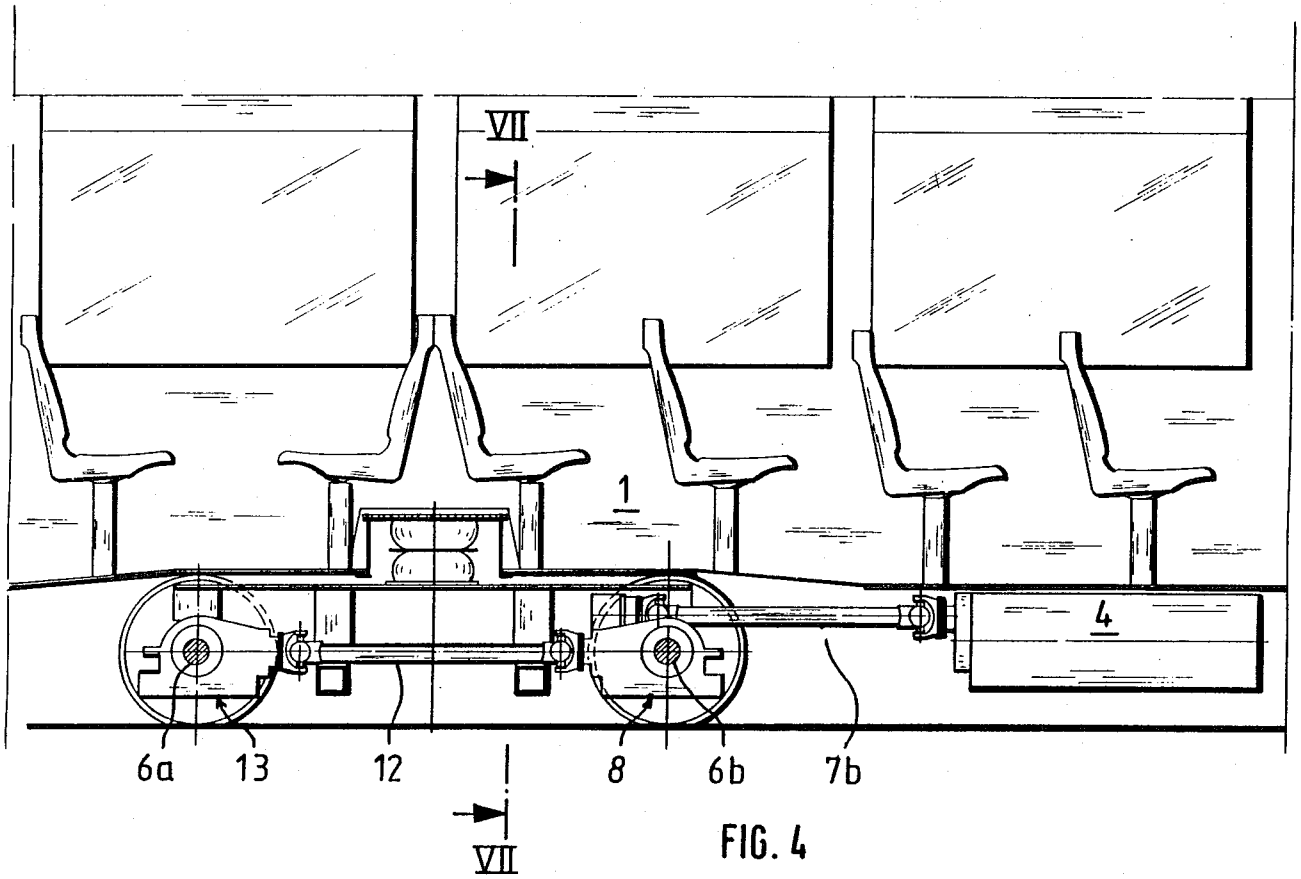
FIG. 4 is a side view of a car body, in the region of the driving bogie, and shows a single drive motor.

FIG. 4 shows a modified embodiment for the drive mechanism. In this embodiment, a single drive motor 4 is shown that drives the wheel set 6*b* via the drive shaft 7*b*. The speed of the drive shaft 7*b* is reduced by the reduction gear mechanism 8. The torque is conveyed further to the second wheel set 6*a* via a second drive shaft 12 and gear mechanism 13.

Figure 5:
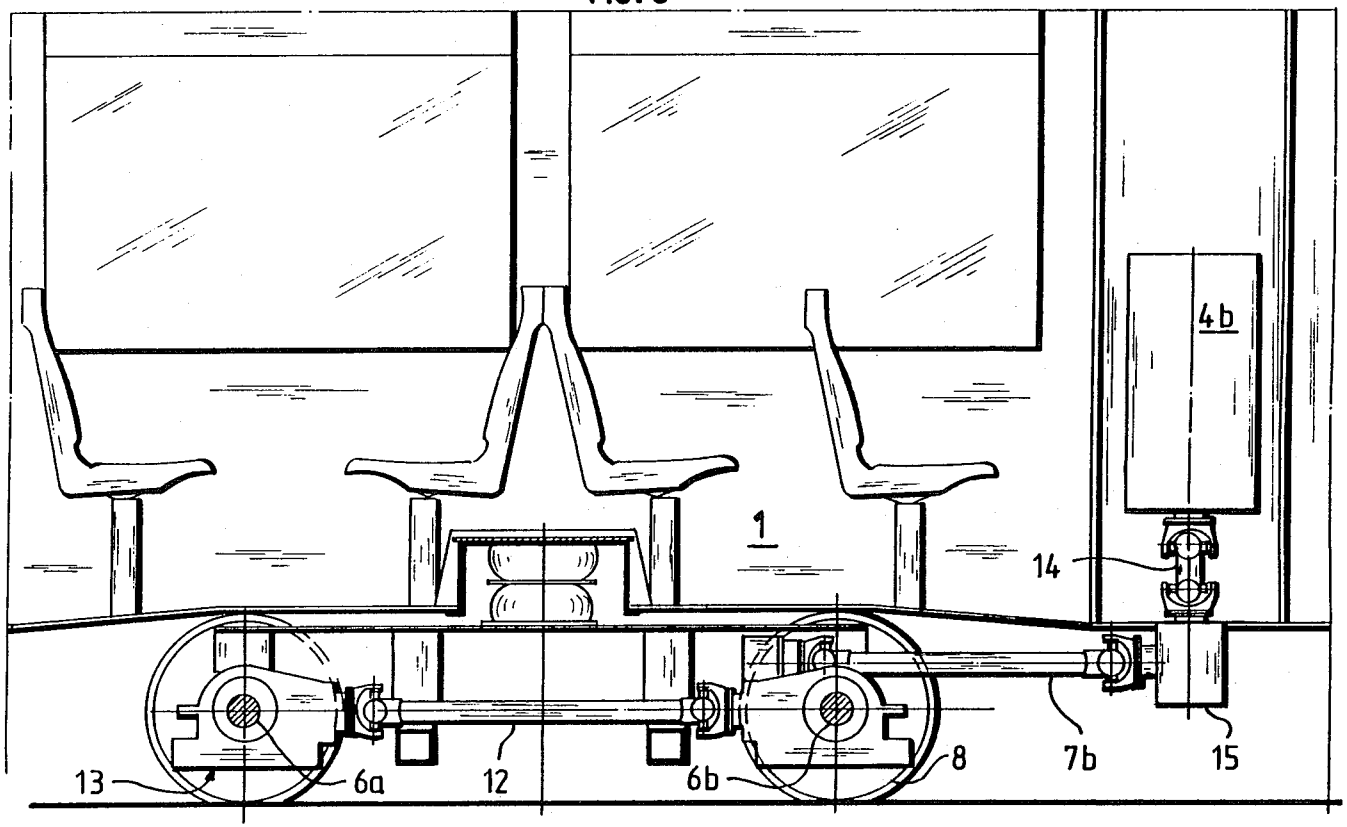
FIG. 5 is a side view of a car body having a vertical motor.

FIG. 5 shows a further embodiment for the drive mechanism, in this case with a drive motor 4*b* that is disposed vertically in the car body 1. The drive motor 4*b* transmits torque to the drive shaft 7*b* via a first drive shaft 14 and a bevel gearing 15. From there the torque is transmitted further in the same manner as described in connection with the embodiment of FIG..4.

In the cross-sectional view of FIG. 6, as was the case in FIG. 3, drive is effected by two motors 4, 4*a* (FIG. 3), with only the drive motor 4 with the reduction gear mechanism 8, which drives the wheel set axle 6, being shown. The drive motor 4 is disposed to the side below the car body 1. The longitudinal members 10 of the driving bogie 3 are connected by bent or angled cross members 11, thus allowing room for the low-lying central walkway 2 that extends through the entire train. Entry and exit can be effected at the level of the central walkway 2.

The cross-sectional view of FIG. 7 shows a drive possibility using a single motor 4. As can be seen from FIG. 4, this motor drives a reduction gear mechanism 8 which in this case is disposed inwardly of the wheels 16 and drives the axle 6.

Figure 8:
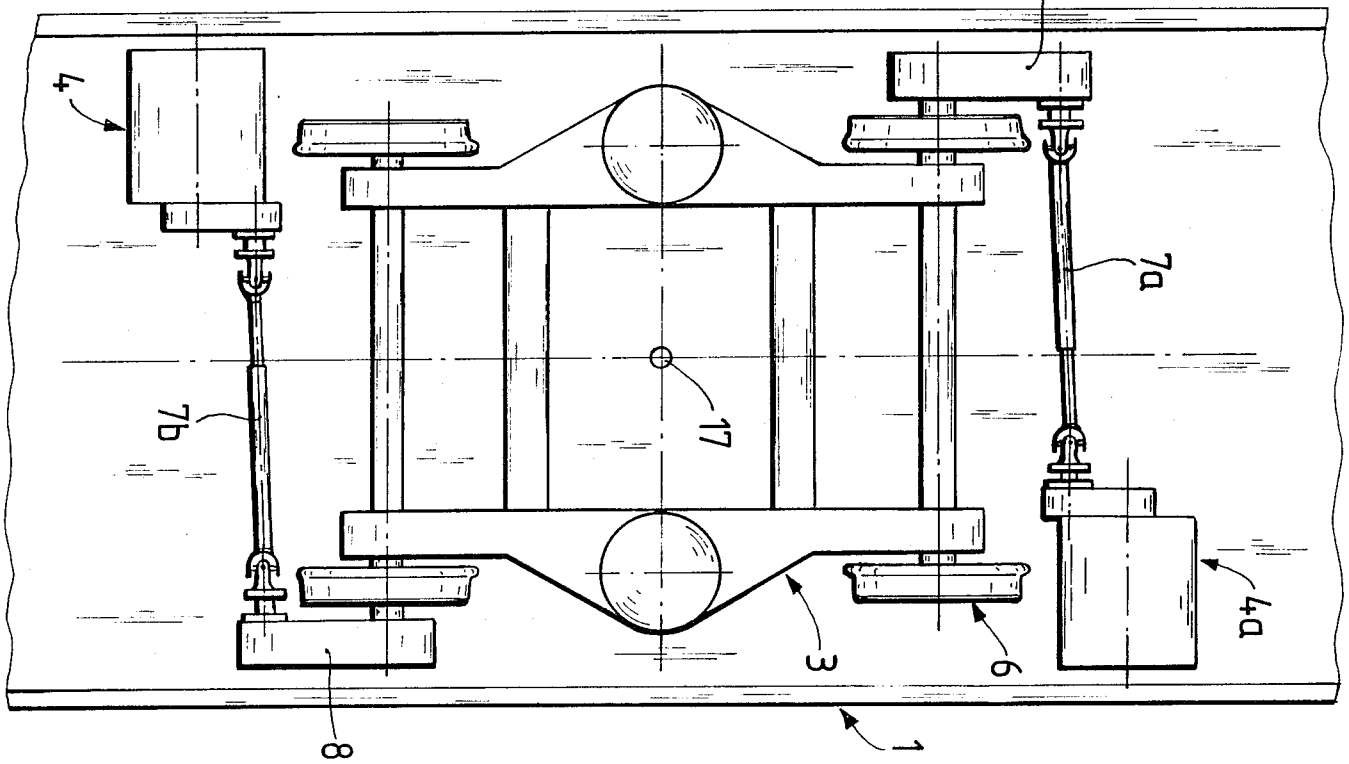
FIG. 8 is a plan view of a driving bogie having two drive motors, the drive shafts of which are essentially parallel to the wheel sets.

The plan view of FIG. 8 illustrates a driving bogie having two drive motors 4 and 4*a*. The drive shafts of the motors 4, 4*a* are disposed parallel to the axles of the wheel sets 6. The drive motors are suspended to the sides below the car body 1 and diagonally relative to the point of rotation 17. Via drive shafts 7*a* and 7*b*, accompanied by the interposition of reduction gear mechanisms 8*a* and 8, the drive motors are connected to the wheel sets 6 in such a way as to be able to transmit torque. The drive shafts 7*a* and 7*b*, as illustrated in FIG. 8 of the drawings, are located as mounted or journalled substantially transverse below the car body 1 and are offset to compensate for longitudinal movements thereof resulting from turning movements of the driving bogie 3. The reduction gear mechanisms 8, 8*a* are disposed at the ends of the wheel sets 6, resulting in easy assembly and, due to the good accessibility, trouble free and economical maintenance.

Figure 9:
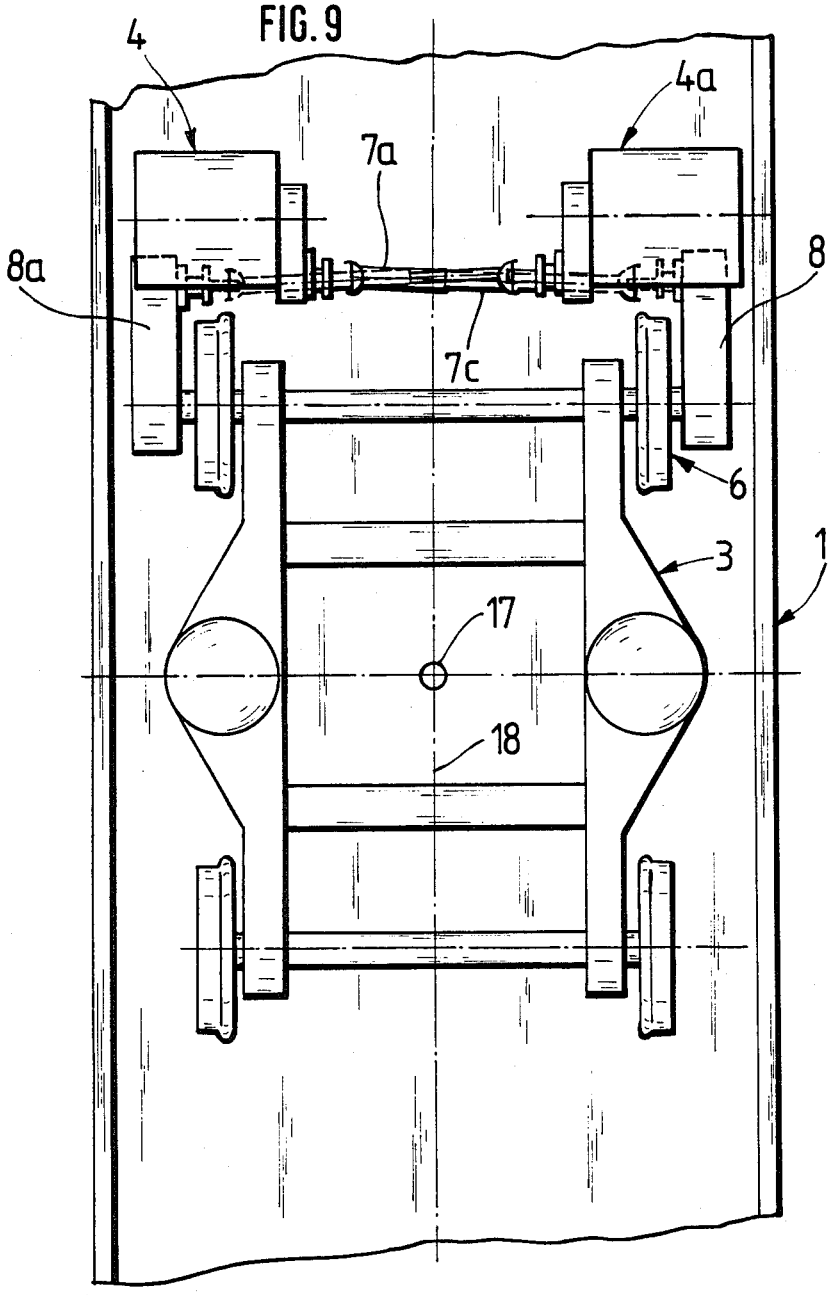
FIG. 9 is a plan view of a driving bogie having two drive motors that are disposed symmetrical relative to a longitudinal axis.

The plan view of FIG. 9 shows a modification of the drive mechanism illustrated in FIG. 8. In this drive mechanism, the drive shafts of the two drive motors 4 and 4*a* are disposed parallel to the axles of the wheel sets 6, below the car body 1, yet are symmetrical relative to a longitudinal axis 18 of the bogie 3. A driving of one of the wheel sets 6 is effected via drive shafts 7*a* and 7*c* accompanied by the interposition of reduction gear mechanisms 8*a* and 8 that are disposed at the ends of the wheel sets 6.

In summary, the present invention provides a multi-unit rail vehicle for commuter traffic, with each of the pivotably interconnected car bodies of the vehicle being supported, via rubber springs as secondary shock absorbers, on a driving bogie that is disposed below the center of that car body and that has longitudinal members in an arrangement constructed to avoid having height of a vehicle floor relatively high due to the driving bogie so that a complicated entry or exit is required in order to enable comfortable boarding and disembarking where a railway platform is at a level of the street. In a combination of features according to the present invention, each drive motor is mounted and disposed transversely below the pertaining car body, the same being disposed off to the side and being located beyond a pivot range of the associated bogie, and with transfer of torque being effected from a given one of the drive motors to at least one wheel set of the associated bogie via drive shaft means and reduction gear mechanism means, the drive shaft means being located substantially transversely and also being offset to compensate for longitudinal movements thereof resulting from turning movements of the driving bogie. Angled-off cross members interconnect the longitudinal members of a given driving bogie in such a way as to accommodate, with clearance, a level central walkway that extends in the pertaining car body through the entire vehicle. A given driving bogie has a longitudinal axis and a point of rotation, and also two drive motors are provided operatively connected therewith; the drive shaft means of the drive motors are essentially disposed parallel to the axle of the wheel sets of the bogie; relative to the point of rotation, the drive motors are disposed diagonally across from one another on opposite sides of the longitudinal axis; and each of the drive motors transfers torque to a given wheel set via drive shaft means and a reduction gear mechanism that is disposed in a complementary diagonally opposite location outside of the wheel set arranged to embody driving bogies and car bodies in such a way that entry and exit can be effected without complicated and inconvenient step constructions, and that a passenger can walk along an entire train at the same level without having to negotiate steps and the like.

The present invention is, of course, in no way restricted to the specific disclosure of the specification and drawings, but also encompasses any modifications within the scope of the appended claims.

What we claim is:

1. A multi-unit rail vehicle having multiple pivotably interconnected car bodies for commuter traffic, with each of the pivotably interconnected car bodies of the vehicle being supported, via rubber springs as secondary shock absorbers, on a driving bogie that is disposed below the center of that car body via a pivot mounting with wheel sets also arranged centrally independent the car body in order to solve a problem of height of the vehicle as well as balancing of moments of force transmitted to the wheel sets and that has longitudinal members arranged to the sides of the rail vehicle so as to avoid having a vehicle floor substantially higher than an adjacent street level, said vehicle combination further comprising:

at least one drive motor for each of said driving bogies, with each drive motor being mounted to and disposed transversely below the pertaining car body, being disposed off to the side, and being located beyond a pivot range of the associated bogie, and with transfer of torque being effected from a given one of said drive motors to at least one wheel set of said associated bogie via drive shaft means and reduction gear mechanism means, said drive shaft means being located substantially transversely of a longitudinal axis of said vehicle and also being offset from the pivot range of the associated bogie to compensate for longitudinal movements thereof resulting from turning movements of the driving bogie; and angled-off cross members interconnecting said longitudinal members of a given driving bogie, each of said cross members including a mid-section positioned lower than the level of said longitudinal members so as to accommodate, with clearance, a uniform level central walkway that extends in the pertaining car body through the entire vehicle, a given driving bogie having a longitudinal axis and a point of rotation, and having two drive motors mounted to the car body and operatively connected to the driving bogie via shaft means and reduction gear mechanisms, said drive motors located in the substantially diagonally opposite locations underneath the car body, the drive shaft means of which are essentially disposed parallel to axles of the wheel sets of said bogie and beyond the pivot range of said driving bogie, relative to said point of rotation, said drive motors are disposed diagonally across from one another on opposite sides of said longitudinal axis; and said reduction gear mechanisms disposed outside of said wheel set so that entry and exit can be effected without complicated and inconvenient step constructions, and that a passenger can walk along an entire train at the same level without having to negotiate steps and the like.

2. A rail vehicle in combination according to claim 1, in which a given driving bogie is provided with two drive motors that are disposed diagonally across from one another below said car body and off to the side, with each drive motor having associated with it a reduction gear mechanism oppositely diagonally disposed which reduction gear mechanism is mounted on a remote end of an associated wheel set.

3. A rail vehicle in combination according to claim 1, in which a given driving bogie is provided with a single drive motor disposed below said car body and off to the side, with said drive motor having a first drive shaft that transfers torque to a first wheel set of said driving bogie via a first reduction gear mechanism, which is disposed within said first wheel set; and in which said driving bogie includes a second drive shaft and a second gear mechanism for transfer of torque from said first wheel set to a second wheel set of said driving bogie.

4. A rail vehicle in combination according to claim 1, in which a given driving bogie is provided with a drive motor which is disposed in said car body and transfers torque to a first wheel set of said bogie via a first, vertically disposed drive shaft, a bevel gearing, a second drive shaft, and a first reduction gear mechanism, which is disposed within said first wheel set; and in which said driving bogie includes a second drive shaft and a second gear mechanism for transfer of torque from said first wheel set to a second wheel set of said driving bogie.

5. A rail vehicle in combination according to claim 1, in which a given driving bogie has a longitudinal axis and a point of rotation, and has two drive motors operatively connected therewith, the drive shaft means of which are essentially disposed parallel to the wheel sets of said bogie; relative to said point of rotation, said drive motors are disposed symmetrically relative to said longitudinal axis; and in which each of said drive motors transfers torque to a given wheel via drive shaft means and a reduction gear mechanism that is disposed outside of said wheel.

* * * * *